US005224631A

United States Patent [19]

Wells et al.

[11] Patent Number: 5,224,631

[45] Date of Patent: Jul. 6, 1993

[54] COMBINED CAN TOP AND NOZZLE

[75] Inventors: James D. Wells, Charlotte; Horst O. Abramowski, Matthews, both of N.C.

[73] Assignee: Radiator Specialty Company, Charlotte, N.C.

[21] Appl. No.: 831,844

[22] Filed: Feb. 6, 1992

[51] Int. Cl.[5] ..... B67D 1/07

[52] U.S. Cl. ..... 222/192; 222/402.1; 239/289

[58] Field of Search ..... 222/192, 402.1, 538, 222/562; 239/289

[56] References Cited

U.S. PATENT DOCUMENTS 2,985,382 5/1961 Coplan ..... 222/538 X
4,413,756 11/1983 Kirley ..... 222/538 X
4,759,501 7/1988 Silvenis et al. ..... 239/289 X
4,767,034 8/1988 Cramer ..... 222/192 X
4,805,814 2/1989 Allen, Sr. ..... 222/538

*Primary Examiner*—Gregory L. Huson
*Attorney, Agent, or Firm*—Mason, Fenwick & Lawrence

[57] ABSTRACT

A combined cap and nozzle for a container is provided, having a skirt, a transverse wall, and having a restricted orifice of small diameter through the wall. A coupling is provided, being preferably standard female threads as used in garden hoses, for attachment with a conduit such as with the male coupling of a garden hose. Water from a residential faucet may be passed through the garden hose and the restricted orifice to impact on and dislodge waste from a body.

14 Claims, 2 Drawing Sheets

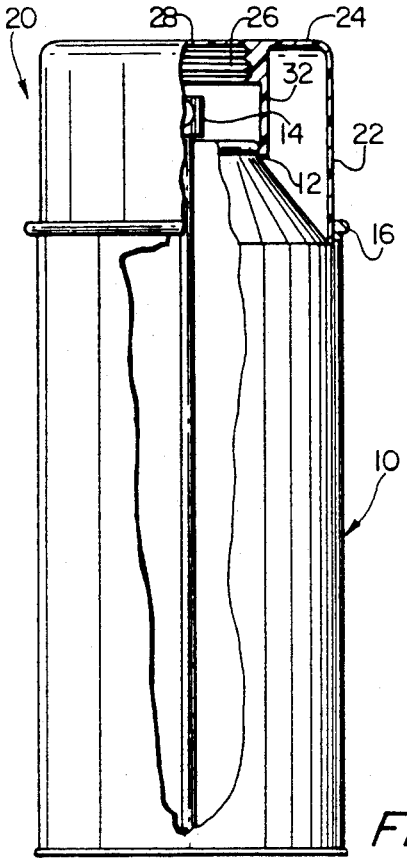
FIG. 1
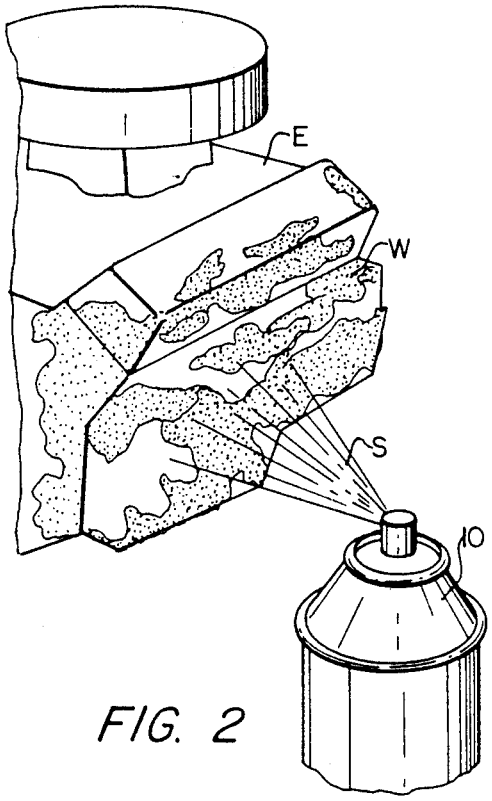
FIG. 2
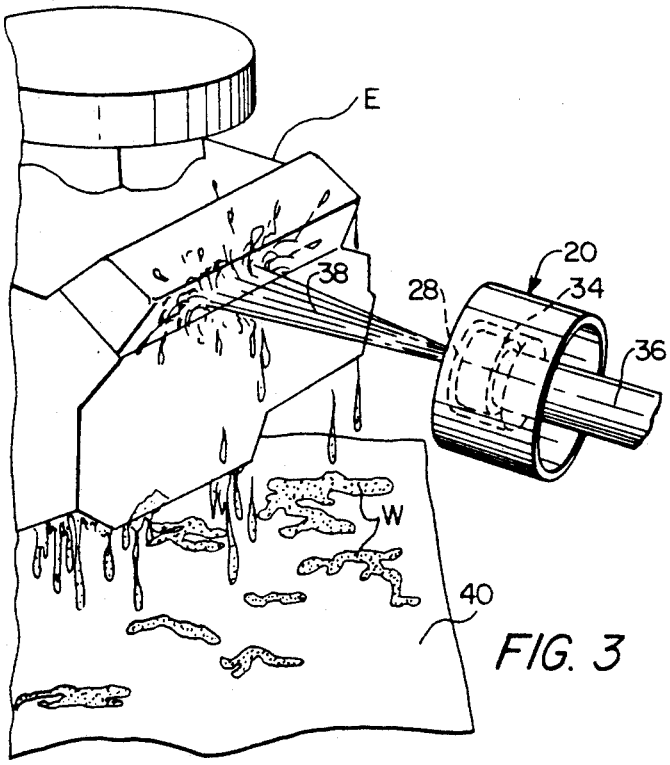
FIG. 3
FIG. 4
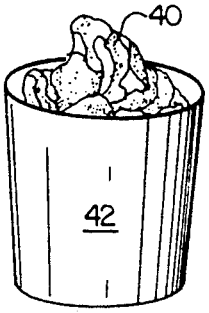

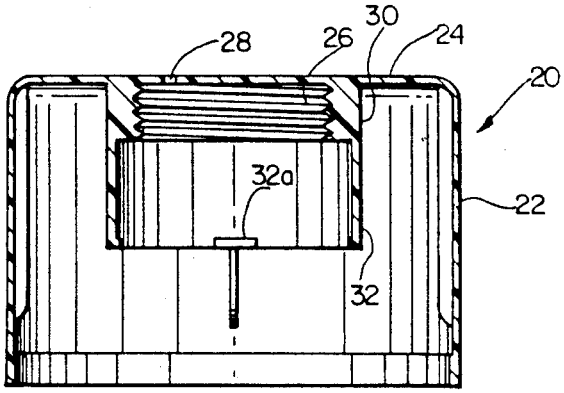
FIG. 5
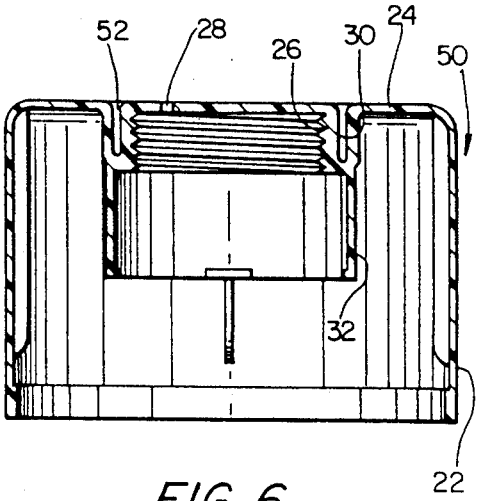
FIG. 6
FIG. 7
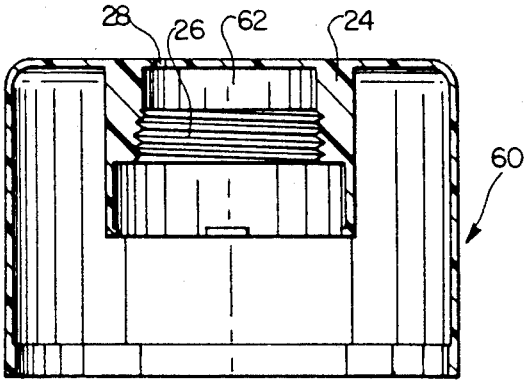
FIG. 8
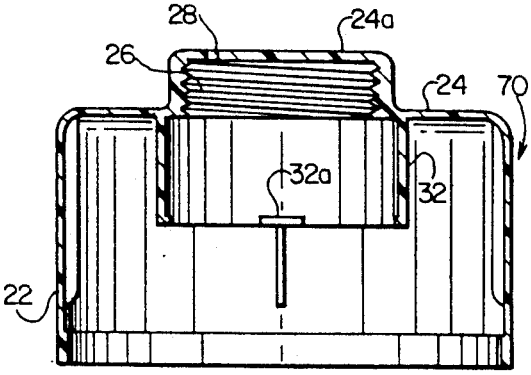
FIG. 9
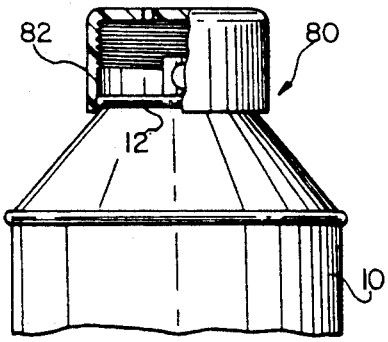

COMBINED CAN TOP AND NOZZLE

FIELD OF THE INVENTION

The present invention relates to a method for removing waste from a body, such as petroleum based waste, and to an apparatus for readily removing such waste from a body.

BACKGROUND OF THE INVENTION

Bodies such as automobile engines and various kinds of machinery and apparatus become coated with a waste material. This waste material may be oil, e.g., petroleum, based, being a mixture of lubricating oil and dust or dirt. The lubricating oil soils the outside of the automobile engine, being deposited there when oil is spilled when added to the engine to replace oil which has leaked or been burned in the engine. Also, oil fumes may condense on the exterior of the engine or carry liquid oil droplets which are deposited on the engine, and in either case, the liquid engine oil captures dirt and dust particles. The result is a petroleum based mass, somewhat spongy, which over time builds to a substantial thickness on the exterior of the engine. This petroleum based waste is undesirable, and its removal and proper disposal presents a problem since petroleum waste may contain undesirable constituents such as lead and zinc, which contaminate the environment.

Another, and related problem, is in connection with removal of water based material from automobiles, and other machinery. Water based waste is deposited on the automobile or other machinery, for example, in the engine compartment, in the wheel wells, and on the exterior. Causes for such deposits include rain, snow, and wet pavements as the primary sources of the water; with that water there is mixed dust, dirt and various atmospheric particles. Removal of the water based waste does not tend to contaminate the environment, but heretofore, an excessive amount of potable water has often been used to effect the task of cleaning the water based waste from the automobile or the machinery.

To facilitate the removal of the petroleum based waste on the exterior of an internal combustion engine, there is widely used a chemical composition which is sprayed on the petroleum based waste from a spray can: a spray can is typically a small hand held cylindrical container containing a propellant, which is usually gaseous, and a chemical material in liquid form. At one end of the cylindrical metal container, there is provided a spray nozzle, which is depressed to open a valve to permit the liquid material to escape and to be delivered to the petroleum based waste. The liquid material dissolves the oil based waste to lessen or weaken the adherence of it to the external surfaces of the internal combustion engine, and may contain a detergent.

While the sprayed waste removal liquid loosens or weakens the adherence of the petroleum and water based waste to the internal combustion engine, it is usually required that it be removed by mechanical force. Such force has been most conveniently delivered by utilizing a conventional garden hose to discharge water against the waste and the internal combustion engine, the impact of the water knocking the petroleum based waste loose from the internal combustion engine. The garden hose was typically connected to a faucet connected to a domestic water system, water passing into the water system through a pressure control valve which reduces the pressure in the system to a standard, approximately 25–60 psig. A similar water pressure is provided where the origin of the water is a well and pump system: the available water pressure in such systems is generally the same as that in the conventional water systems which supply water to a large number of residences.

The engine cleaning process, as above described, has been typically performed by individual automobile owners at their place of residence. After the water from the garden hose had dislodged the petroleum and water based waste, the area under the automobile was cleaned by flushing with water from the hose, either to clean a driveway, or to disperse the waste into a lawn. The petroleum components of the waste were thus flushed into storm water systems, for discharge into streams and rivers, while the petroleum constituents which were dispersed in a lawn were, by the effects of natural precipitation and watering of the lawn, introduced into underground streams, and thence into surface streams and rivers. Consequently, there are two problems with the presently used method and apparatus from the point of view of environmental concerns. One is contamination of streams and rivers with hydrocarbons and other constituents of the petroleum, and the other is the utilization of an unacceptably large amount of potable water. The latter is, of course, of particular concern in those regions where potable water is in short supply.

SUMMARY OF THE INVENTION

There is provided a method for removing waste such as petroleum and water based waste, from the underhood area of a car in general, and more specifically to the surface of an internal combustion engine by applying a loosening agent to the waste, and thereafter removing the waste from the body by impacting it with a liquid stream and accumulating or collecting the waste and any associated liquid, for subsequent disposal.

More particularly, the accumulation or collection of the removed petroleum and water based waste is by a material which can be incinerated, such as newspapers.

In addition, a minimal amount of water is used to remove the petroleum and water based waste, in order to consume as little potable water as possible, and in order to avoid having an excessive amount of material to be subsequently handled.

The apparatus in accordance with the present invention comprises a can or other container of fluid having a property of loosening the adherence of water based and/or petroleum based waste to a surface, in combination with a combined cap and nozzle for placement on the container, which has means, such as an elastic skirt, for engaging the container, together with a coupling, preferably in the form of female threads, for coupling the cap to a conventional garden hose coupling, there being in the cap an orifice of limited size which is in communication with a hose or other conduit coupled to the cap' the invention also comprises the combined cap and nozzle.

Among the objects of the present invention are to provide a method and apparatus to encourage petroleum waste removal practices which are less harmful to the environment than presently used methods and apparatus.

A further object of the present invention is the provision of a method and apparatus which will avoid the deposit of petroleum based products and their contaminates in the ground and in natural bodies of waters and in sewer systems.

Still another object of the present invention is the provision of a method and apparatus which will facilitate the removal of petroleum and water based waste from an object, and facilitate in addition the disposal thereof in a manner which is protective of the environment.

Still another object of the present invention is to provide a method and apparatus to facilitate removal of petroleum or water based waste requiring only minimal water consumption.

Yet another object of the present invention is the provision of an apparatus for enabling the ready removal of petroleum or water based waste from a surface, utilizing a conventional garden hose, and a minimal amount of water.

A further object of the present invention is to provide such an apparatus which will require the use of a substantially lesser amount of water than has previously been used for this purpose.

Other objects and many of the attendant advantages of the present invention will be readily understood from the following drawings, as well as the specification and claims appended hereto.

BRIEF DESCRIPTION OF THE DRAWINGS

FIG. 1 is an elevational view, partly in cross-section, of a spray can, and combination cap and nozzle in accordance with the present invention.

FIG. 2 is a diagrammatic view of the spray can shown in FIG. 1 being used on an internal combustion engine having petroleum based waste thereon.

FIG. 3 is diagrammatic view illustrating the removal of petroleum based by use of a combined cap and nozzle and forming part of the structure of FIG. 1, and the accumulation thereof.

FIG. 4 illustrates the disposal of the petroleum based waste after accumulation thereof on a collector.

FIG. 5 is a cross-sectional view of the combined cap and nozzle of FIG. 1.

FIG. 6 is a cross-sectional view of another embodiment of the combined cap and nozzle.

FIG. 7 is a cross-sectional view of a still further embodiment thereof.

FIG. 8 is a cross-sectional view of another embodiment thereof.

FIG. 9 is a cross-sectional view of still another embodiment of a combined cap and nozzle.

DESCRIPTION OF THE PREFERRED EMBODIMENTS

Referring now to the drawings, wherein like or corresponding reference numerals are used to designate like or corresponding parts throughout the several views, there is shown in FIG. 1 a container 10, which is preferably a metal can of cylindrical construction having at one end 12 thereof a nozzle and valve 14. The container 10 has within it a liquid which has the characteristics of lessening the adherence of petroleum based waste on a surface, such as one the surface of an internal combustion engine E. The container 10 may also contain a gaseous propellant for forcing the liquid contents of the container from the container vessel when the nozzle and valve 14 is operated. Such containers are conventionally called "spray cans" and have been widely used for various purposes. Although a container with a gaseous propellant has been disclosed, other kinds of containers may be utilized, such as those having a pump for discharging the liquid from the container in a stream.

On the spray can or container 10, there is shown a combined cap and nozzle 20 which has a cylindrical resilient skirt 22, and a transverse wall 24. The skirt 22 has a press or snap-fit connection with the container 10, engaging an internal bead or flange 16 at the end 12 thereof, to thereby be releasably attached to the container 10.

The combined cap and nozzle 20 also includes female threads 26, generally beneath the wall 24, and there is an orifice 28 in the wall 24 which is within the ambit of the female threads 26. There is also provide a second, depending skirt 32 of less diameter than the outer skirt 22, which is in axial alignment with the female threads 26, and which is inwardly of the skirt 22. The inner skirt 32 may have tangs **32*a* (see FIG. 7) for engaging a lip of the can 10 to provide a readily detachable connection to the can 10**.

The combined cap and nozzle 20 will be seen to be detachably connected to the container 10 in conventional fashion: for example, by the inwardly directed bead or flange **16*a*, and the resilient skirt 22 and/or the skirt 32 and tab 32**.

Referring now to FIG. 2, there is shown an internal combustion engine E having on the surfaces thereof petroleum based waste W. The waste W is, as is well known, oil used in the engine E, which has escaped or leaked, mixed with dirt and dust, forming an agglomerated, spongy mass. Water may also be present in the mass of waste W. The container 10 is shown discharging a spray S of adherence-lessening liquid, such spray cans and liquids having been produced and used for many years. As will be understood, the can 10, as shown, contains a gaseous propellant, but a pump type spray container may be used instead.

After the adherence of the petroleum based waste W to the internal combustion engine E has been lessened, as shown in FIG. 3, the combined cap and nozzle 20 is coupled to the male coupling 34 of a conventional hose such as a garden hose 36. The hose 36 is connected to a water faucet, which receives a supply of water either from a well or from a municipal water system. In either event, the water pressure in the hose 36 is on the order of 25–60 psig. The water will issue through the orifice 28, as a relatively narrow, relatively high pressure stream 38. The impact of the water stream 38 will remove the petroleum based waste W, which falls and is accumulated on a collector 40. As shown, the collector 40 rests on the ground, and is preferably of a combustible material, such as newspaper, or other combustible product made of plant fibers. Newspaper is, however, preferred, since there is no additional cost required for it.

After the internal combustion engine E has been cleaned by removal of the petroleum based waste W, and the accumulation of it on the collector 40, the collector 40, with the petroleum based waste thereon or therein, and with some or all of the water which has issued from the orifice 28, is then placed in a receptacle 42. The receptacle 42 is preferably one which is designated for such waste, so that classified waste material which can be burned is delivered for disposal, as to an incinerator. As will be recognized, the amount of water is greatly restricted, both to reduce the mass of waste which is to be handled and to minimize the consumption of potable water.

Referring now FIG. 5, there is shown in enlarged cross-section a combined cap and nozzle 20, including skirt 22, wall 24, a boss 30 having the female threads 26 therein, and the second skirt 32 which is within the skirt 22. The second skirt 32 is provided with the tangs 32*a* to provide for attachment to a container such as a spray can. There is shown the orifice 28, which preferably has a diameter of 0.062 (sixty-two thousandths) inches, and this is within the ambit of the female threads 26, so that there is fluid communication between orifice 28 and the hose 36 (see FIG. 3) when the combined cap and nozzle 20 is coupled to it. The threads 36 extend to the wall 24 the boss 30 is solid and unbroken.

In FIG. 6, there is shown a combined cap and nozzle 50 which is substantially identical to the combined cap and nozzle 20 except that there is a groove 52 in the boss 30 extending transversely of the wall 24.

In FIG. 7, there is shown another embodiment of the combined cap and nozzle designated 60. In this embodiment, the female threads 26 terminate in spaced relation to the wall 24, so that there is a chamber 62 between the end of the male coupling 34 and the wall 24.

In FIG. 8, there is shown an alternate embodiment of a combined cap and nozzle 70 in which the wall 24 comprises a first central disc-like portion 24*a*, and an annular portion 24*b*, which extends between the boss 30 and the skirt 22. There may be seen also the second skirt 32, with tangs 32*a*. The boss 30 is provided with female threads 26, which are of conventional diameter and pitch to be coupled with the standard male thread used on hose couplings.

FIG. 9 discloses a combined cap and nozzle 80 having a resilient skirt 82 for engaging the bead 10 of a cam 10.

There has been provided a method for removing and disposing of petroleum and water based waste from automobiles and machinery which permits the segregation of such waste and other waste, for disposition in a manner, such as incineration, which is least harmful to the environment. The herein disclosed method is simple and economical, and has the advantage of utilizing a minimal amount of potable water.

There have also been disclosed herein a container, such as a spray can, and a combined top and nozzle which facilitate the removal of waste, petroleum based and/or water based, using a minimal amount of potable water, thereby having the advantage of lessening water consumption, the risk of environmental contamination, and minimizing the amount of waste material to be disposed of.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. Apparatus for removing petroleum and water based waste from a body by sequentially applying to the body a material to reduce the attachment of petroleum and water based waste thereto, and water, comprising:

a container having therein a material to reduce the attachment of petroleum and water based waste to a body, said container comprising a material discharging element extending therefrom for discharging said material onto a body having said waste thereon, and a cap in one position thereof being on said container and enclosing said discharging element, said cap having a top with a restricted orifice therein, and having a coupling of substantially larger diameter than said orifice in fluid communication with said orifice, said coupling being of size and configuration for coupling the cap with a conventional garden hose coupling in a second position thereof when removed from said container and coupled to a garden hose for discharging a high velocity stream of water onto a said body.

2. The combination of claim 1, said container having a propellant for liquid therein.

3. The combination of claim 1, said container being substantially cylindrical and having spaced end, said discharging element comprising a nozzle at an end of said container.

4. The combination of claim 3, said cap extending beyond said nozzle and comprising a substantially cylindrical skirt and a transverse wall, said orifice extending through said wall.

5. The combination of claim 4, and a boss extending transversely of said wall.

6. The combination of claim 5, said coupling comprising female threads in said boss.

7. A combined cap and hose nozzle adapted to be placed on a container and to be coupled to the coupling of a hose, comprising:

means for engaging and holding said combined cap and nozzle on said container, a wall transverse of said engaging and holding means a flow restricting orifice in said wall, and means for coupling a base conduit of large size relative to said orifice to said cap wall in fluid communication with said orifice when said cap is not engaged with said container.

8. The combined cap and hose nozzle of claim 7, said engaging and holding means comprising a skirt.

9. The combined cap and hose nozzle of claim 7, wherein said coupling means comprises threads.

10. The combined cap and hose nozzle of claim 7, wherein said coupling means comprises female threads.

11. The combined cap and hose nozzle of claim 7, wherein said means for engaging and holding said combined cap on said container is of larger diameter than said coupling means, and is substantially coaxial therewith.

12. The combined cap and hose nozzle of claim 7, wherein said means for engaging and holding said combined cap on said container is of substantially the same diameter as said coupling means, and is substantially coaxial therewith.

13. The combined cap and hose nozzle of claim 7, said holding and engaging means comprising a skirt, and a boss within said skirt, said coupling comprising female threads in said boss.

14. The combined cap and hose nozzle of claim 13, wherein said orifice has a diameter of approximately 0.062 inches.

* * * * *

UNITED STATES PATENT AND TRADEMARK OFFICE

CERTIFICATE OF CORRECTION

PATENT NO. :5,224,631

DATED :July 6, 1993

INVENTOR(S) :Wells et al.

It is certified that error appears in the above-identified patent and that said Letters Patent is hereby corrected as shown below:

Col. 6, line 19, please delete "end" and insert -- ends --.

In the Claims:

In Claim 7, line 38, please delete "base" and insert -- hose --.

Signed and Sealed this

Seventeenth Day of May, 1994

Bruce Lehman

BRUCE LEHMAN

*Commissioner of Patents and Trademarks*

*Attest:*

*Attesting Officer*